United States Patent [19]

Hammock

[11] 4,345,566

[45] Aug. 24, 1982

[54] FUEL PUMPING APPARATUS

[75] Inventor: Michael T. Hammock, Holmer Green, England

[73] Assignee: Lucas Industries Limited, Birmingham, England

[21] Appl. No.: 213,594

[22] Filed: Dec. 5, 1980

[30] Foreign Application Priority Data

Jan. 22, 1980 [GB] United Kingdom ..... 8002111

[51] Int. Cl.[3] ..... F02D 1/06

[52] U.S. Cl. ..... 123/502; 123/179 L

[58] Field of Search ..... 123/502, 501, 500, 179 L, 123/366, 368; 417/213, 219

[56] References Cited

U.S. PATENT DOCUMENTS

| | | | |
|---|---|---|---|
| 3,973,540 | 8/1976 | List | 123/502 |
| 4,224,916 | 9/1980 | Davis | 123/502 |
| 4,282,844 | 8/1981 | Skinner | 123/502 |

FOREIGN PATENT DOCUMENTS

| | | | |
|---|---|---|---|
| 1283596 | 11/1968 | Fed. Rep. of Germany | 123/501 |

*Primary Examiner*—Charles J. Myhre

*Assistant Examiner*—Carl Stuart Miller

[57] ABSTRACT

A fuel pumping apparatus for supplying fuel to a compression ignition engine includes an injection pump having a cam ring which can be moved by a piston to vary the timing of delivery of fuel. The piston is biased by compression springs the extension of which is determined by a rod having a transverse pin engageable with cam surfaces defined on an annular member. An operating shaft can be moved angularly to move the pin angularly from a first to a second position so that it contacts a different portion of the cam surface, when it is required to start the engine. During this movement a spring is stressed and this when the engine starts, moves the pin to a third position for cold idling of the engine. When the engine is warm the shaft is moved to return the pin to the first position.

5 Claims, 7 Drawing Figures

FUEL PUMPING APPARATUS

This invention relates to a fuel pumping apparatus for supplying fuel to a compression ignition internal combustion engine, and comprising an injection pump operable in use in timed relationship with an associated engine, a pump for supplying fluid at a pressure which varies in accordance with the speed at which the apparatus is driven, a cylinder and a fluid pressure operable piston therein responsive to the pressure of said fluid for varying the timing of delivery of fuel by the apparatus such that with increasing speed the timing of delivery of fuel is advanced.

Such apparatus is well known in the art and the fluid pressure acts on the piston in opposition to the force exerted by resilient means which usually has the form of a coiled compression spring. Different engines tend to have differing requirements for the timing of delivery of fuel particularly when starting the engine and when the engine is idling and is also cold. With one known engine it is advantageous to have the delivery of fuel retarded when starting from cold to advance the timeing for cold idling purposes both as compared with the situation when the engine is idling and it is hot.

The object of the invention is to provide an apparatus of the kind specified in a simple and convenient form.

According to the invention an apparatus of the kind specified comprises an end closure for the cylinder, resilient means biasing the piston in a direction away from said end closure said piston being moved against the action of said resilient means to advance the timing of delivery of fuel by the injection pump, a shaft mounted in said end closure for angular movement about the axis of said cylinder, a lever mounted on said shaft and operable in use when it is required to start the associated engine, to move the shaft from an inoperative position to an operative position, said shaft having a hollow end portion presented to the piston and defining a pair of axially extending slots, an actuating rod having one end located within said hollow end portion and mounting an abutment which acts as a stop to determine the extent of movement of the piston under the action of the resilient means, a pin mounted in said actuating rod for engagement by the walls of said slots, an annular member surrounding the hollow end portion of the shaft, said member defining a pair of cam profiles for engagement by the opposite end portions of the pin, each cam profile defining three settings for the pin, the first of which is a normal running position, the second of which is the cold start position in which the piston is allowed to move to a position in which the timing is retarded as compared with the normal running position, and a third setting in which the piston is allowed to move to a position in which the timing is advanced as compared with the normal running position, said pin being moved from said first position to the second position when the shaft is moved from the inoperative to the operative position, the pin being moved at least in part by further resilient means from said second position to said third position when the piston is subjected to fluid pressure.

One example of an apparatus in accordance with the invention will now be described with reference to the accompanying drawings in which.

Figure 1:
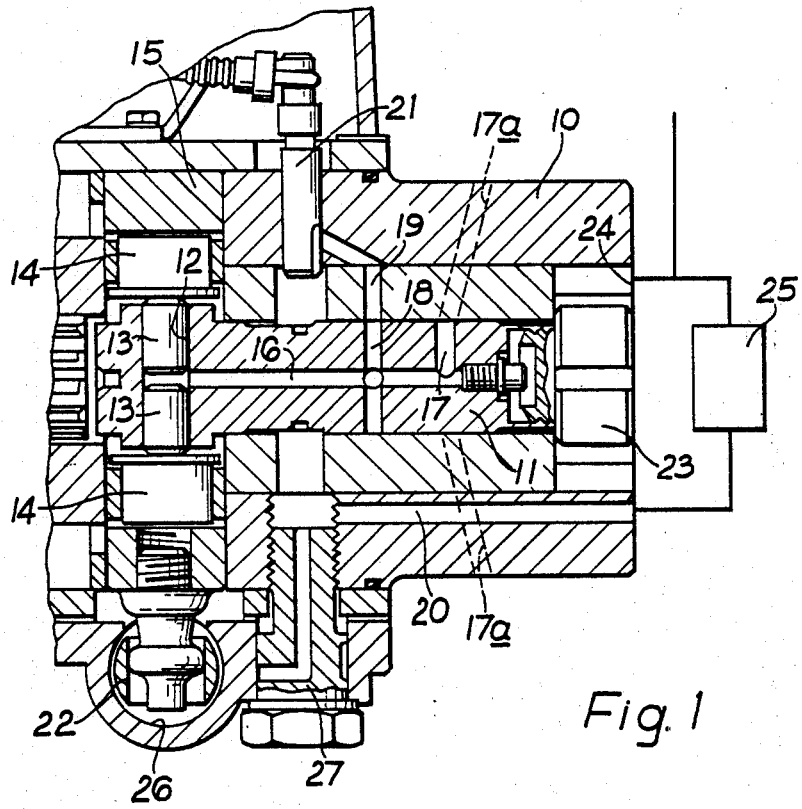
FIG. 1 is a sectional side elevation through the apparatus.

With reference to FIG. 1 of the drawings the apparatus comprises a body part 10 in which is mounted a rotary cylindrical distributor member 11. The distributor member is connected to a shaft whereby it can be driven in timed relationship with an associated engine and formed in the distributor member is a transversely extending bore 12 in which is mounted a pair of plungers 13. The plungers 13 at their outer ends engage cam followers 14 which include rollers respectively engageable with the internal peripheral surface of an angularly adjustable cam ring 15.

The bore 12 communicates with a longitudinal passage 16 formed in the distributor member and this communicates with a radially extending delivery passage 17. The passage 17 can communicate in turn as the distributor member rotates with a plurality of outlets **17*a* formed in the body part 10 and which in use are connected to the injection nozzles respectively of the associated engine. The passage 16 also communicates with a plurality of radially disposed inlet passages 18 which are adapted to register with an inlet port 19 formed in the body part. Also located in the body part is a fuel control means in the form of a throttle member 21 through which fuel flowing through a passage 20 can flow to the inlet port 19. The passage 20 communicates with the outlet of a low pressure supply pump 23 which has an inlet 24. The rotary part of the pump 23 is driven from the distributor member 11 and the inlet and outlet of the supply pump are interconnected by a relief valve 25** which acts to control the output pressure of the supply pump so that it varies in accordance with the speed at which the apparatus is driven.

The plungers 13 constitute the pumping elements of an injection pump and with the setting of the distributor member as shown in FIG. 1, fuel is being supplied from the supply pump 23 by way of the passage 20, the throttle member 21 and the inlet port 19 to the bore 12. As the distributor member rotates communication of the inlet port with one of the inlet passages is broken and the passage 17 moves into register with one of the outlets 17a. Inward movement is now imparted to the plungers by way of the cam followers 14, by means of cam lobes formed on the internal peripheral surface of the cam ring and as the plungers move inwardly, fuel is displaced through an outlet **17*a* to the associated fuel injection nozzle. The cycle is repeated as the distributor member is further rotated and the quantity of fuel which is supplied to the engine is determined by the setting of the throttle member 21**.

It is required to adjust the timing of delivery of fuel to the associated engine and for this purpose a component of the injection pump is adjustable. In this case the component is the cam ring 15 which is angularly adjustable within the body part and which for this purpose is connected by means of a radially disposed peg to a piston 22 which is located within a cylinder 26 this being formed in a part which is secured to the body part 10 by means of a bolt 27 which conveniently provides a fuel connection from the passage 20. There is incorporated in the connection between the passage 20 and the cylinder 26, a check valve (not shown) the purpose of which is to prevent movement of the piston 22 when a reaction force is applied to the cam ring by the engagement of the rollers 14 with the cam lobes.

Figure 2:
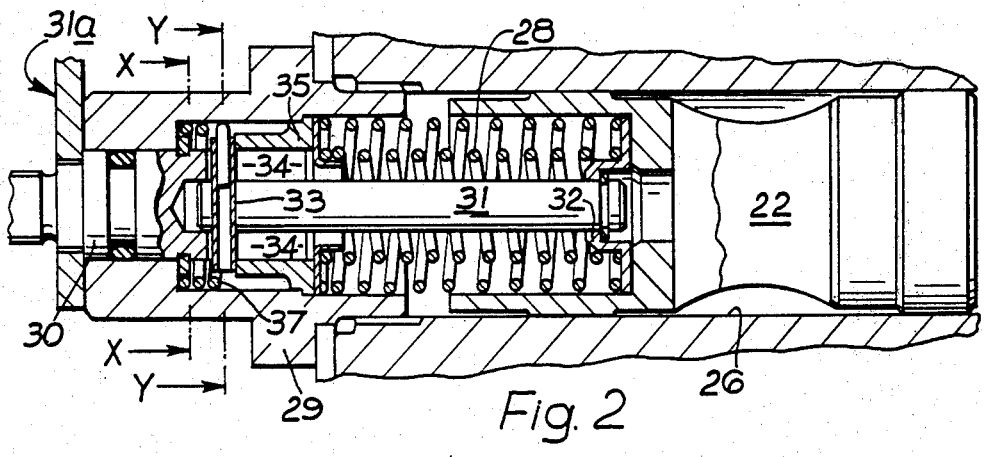
FIG. 2 is a section through part of the apparatus seen in FIG. 1.

Turning now to FIG. 2 the piston 22 is biased by resilient means in the form of coiled compression springs 28, the springs urging the piston in a direction to retard the timing of delivery of fuel to the engine. The cylinder 26 containing the piston is provided with a hollow end closure 29 in which is journalled a shaft 30. The shaft 30 extends from the end closure and has mounted thereon a lever 31$^a$ which can be connected to an operator adjustable control so that the shaft can be moved from an inoperative position to an operative position for the purpose of starting the associated engine when the latter is cold. The shaft has a hollow end portion directed towards the piston 22 and located within the end portion is one end of an actuating rod 31. The rod 31 at its end remote from the shaft, mounts a circlip which is engageable with a spring abutment 32, the abutment 32 being located and secured within a hollow portion of the piston.

Figure 7:
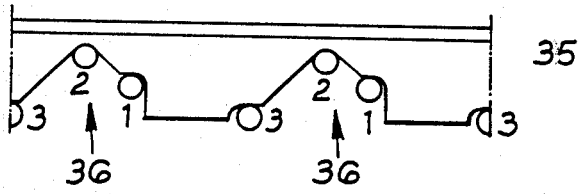
FIG. 7 is a developed view of part of the apparatus seen in FIG. 2.

The rod 31 at its end within the hollow end portion of the shaft, carries a transversely extending hollow pin 33 and the ends of this pin extend through a pair of slots 34 respectively formed in the wall of the hollow end portion of the shaft. Moreover, surrounding the hollow end portion is an annular member 35 which has a peripheral flange engaging a step defined in the end closure. The hollow non-rotatable member also is engaged in a manner to urge the flange into engagement with the step, by an abutment plate against which abuts the springs 28. The annular member 35 is engageable by the ends of the pin 33 and the annular end face defines a pair of cam profiles. The cam profiles are seen in the developed view of FIG. 7. The cam profiles are indicated at 36 the circles shown in FIG. 7 representing the pin 33 in various positions which for convenience are numbered 1, 2 and 3.

Figure 3:
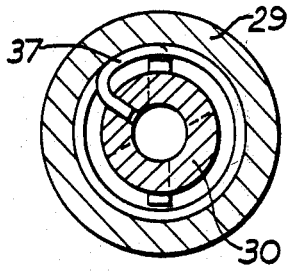
FIGS. 3 and 4 are sections on the lines XX and YY of FIG. 2.

As mentioned above the pin 33 is hollow and engaged within the pin is one end of the helical torsion spring 37 the opposite end of which is engaged as seen in FIG. 3, within the shaft 30.

Figure 4:
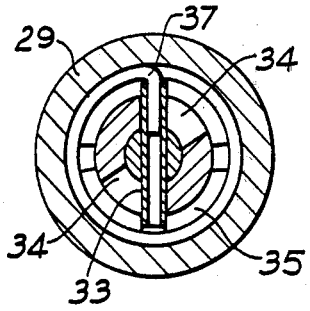
Figure 5:
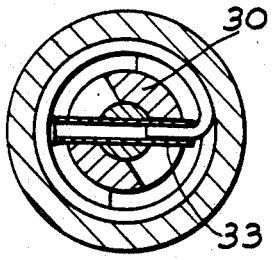
FIGS. 5 and 6 are views similar to FIG. 4 showing parts in alternative positions.
Figure 6:
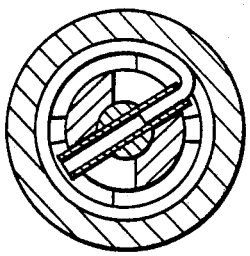

In FIGS. 2, 3, 4 and 6 the shaft 30 is shown in its operative position, that is to say the position to which it is moved when it is required to start the engine. In FIG. 5 the shaft is shown in its inoperative position and considering the setting of the various parts shown in FIG. 5, the pin 33 is in its so-called first setting this being numbered 1 in FIG. 7. When the setting of the pin corresponds to the normal running of the engine when it is hot, and when the engine is idling the maximum retarded position of the piston is determined by the abutment of the pin with steps defined on the cam profiles and numbered 1 as shown in FIG. 7. For starting purposes when the engine is cold it is required that the timing of delivery of fuel should be retarded from the normal running position and in order to achieve this the shaft 30 is moved to the operative position. During such movement the pin 33 is engaged by a pair of walls defining the slots 34 respectively and positively moved angularly to the position shown in FIG. 6. The position of FIG. 6 corresponds to the second setting which is numbered 2 in FIG. 7 and it will be seen that the pin is allowed to move down the slots 34 so that the rod 31 can under the action of the springs 28, move towards the right as seen in FIG. 2. Thus the piston 22 also moves to the right and the timing of delivery of fuel is retarded as compared with the first setting. In addition, the spring 37 is stressed by the fact that the shaft 30 has been moved as clearly demonstrated by FIGS. 5 and 6, through approximately 90° whereas the pin 33 has only been able to move approximately 30°. The pin is prevented from moving further by the fact that in the second setting the ends of the pin 33 lie at the bottoms of the slots. Moreover, the force exerted by the springs 28 also helps to maintain the pin in the second setting. With the pin in this position the engine is cranked for starting purposes and once it starts fluid pressure will be applied to the piston 22 to urge the piston against the action of the springs 28. Once the preload of the springs 28 has been overcome, the piston starts to move and the axial spring force is removed from the pin 33. The pin 33 by virtue of the fact that the spring 37 has been stressed, starts to move towards the third setting which is numbered 3 in FIG. 7 and in which setting the pin is shown in FIGS. 2 and 4. Normally when an engine is started it will temporarily exceed its normal idling speed by virtue of the fact that excess fuel is being supplied however, it may be necessary for the operator of the engine to temporarily increase the operating speed of the engine to ensure that the pin moves to its third setting. This is because the angular movement required of the pin 33 to achieve the third setting is 90° which is the same as the movement of the shaft and therefore the force exerted by the spring 37 will be comparatively small when the pin attains the third setting. In the case where excess fuel is not supplied for starting purposes then the operator will have to increase the engine speed to enable the pn to move to the third setting.

The aforesaid third setting is a stable position and it represents an advancement of the timing of delivery of fuel to the engine as compared with the first setting. Once the engine has attained its normal operating temperature, the operator of the engine will move the shaft from its operative position to its inoperative position and this movement will carry the pin from the third setting through the second setting if the engine is idling to the first setting i.e. the normal running setting.

The lever 31$^a$ may be operated by the engine operator but conveniently it is coupled to a lever which controls the supply of excess fuel by the pumping apparatus for starting purposes and this in turn is connected to an operator adjustable member.

I claim:

1. A fuel pumping apparatus for supplying fuel to a compression ignition internal combustion engine, and comprising an injection pump operable in use in timed relationship with an associated engine, a pump for supplying fluid at a pressure which varies with the speed at which the apparatus is driven, a cylinder, a fluid pressure operable piston in the cylinder, said piston being responsive to the pressure of said fluid to vary the timing of delivery of fuel by the apparatus such that with increasing speed the timing of delivery of fuel is advanced, an end closure for the cylinder, resilient means biasing the piston in a direction away from said end closure, said piston being moved against the action of said resilient means to advance the timing of delivery of fuel by the injection pump, a shaft mounted in said end closure for angular movement about the axis of said cylinder, a lever mounted on said shaft and operable in use when it is required to start the associated engine, to move the shaft from an inoperative position to an operative position, said shaft having a hollow end portion presented to the piston and defining a pair of axially extending slots, an actuating rod having one end located within said hollow end portion and mounting an abutment which acts as a stop to determine the extent of movement of the piston under the action of the resilient means, a pin mounted in said actuating rod for engagement by the walls of said slots, an annular member surrounding the hollow end portion of the shaft, said member defining a pair of cam profiles for engagement by the opposite end portions of the pin, each cam profile defining three settings for the pin, the first of which is a normal running position, the second of which is the cold start position in which the piston is allowed to move to a position in which the timing is retarded as compared with the normal running position, and a third setting in which the piston is allowed to move to a position in which the timing is advanced as compared with the normal running positions, said pin being moved from said first position to the second position when the shaft is moved from the inoperative to the operative position, the pin being moved at least in part by further resilient means from said second position to said third position when the piston is subjected to fluid pressure.

2. An apparatus according to claim 1, in which said resilient means comprises a coiled compression spring and said actuating rod acts to limit the exterior of said spring.

3. An apparatus according to claim 2, in which said slots have a circumferential length sufficient to allow said pin to move from said second to said third position.

4. An apparatus according to claim 3, in which said further reilient means comprises a helical torsion spring acting betweeen said actuating rod and said shaft.

5. An apparatus according to claim 4, in which said pin is hollow and one end of said helical torsion spring is located in said pin, the other end of said helical torsion spring being engaged within an aperture in said shaft.

* * * * *